US008475631B2

(12) United States Patent
Stoyanov et al.

(10) Patent No.: US 8,475,631 B2
(45) Date of Patent: Jul. 2, 2013

(54) REDUCTION OF FIBER KNOTS OF CELLULOSE CROSSLINKED FIBERS BY USING PLASMA PRE-TREATED PULPSHEETS

(75) Inventors: Angel Stoyanov, Federal Way, WA (US); Charles E. Miller, Federal Way, WA (US)

(73) Assignee: Wyerhauser NR Company, Federal Way, WA (US)

( * ) Notice: Subject to any disclaimer, the term of this patent is extended or adjusted under 35 U.S.C. 154(b) by 361 days.

(21) Appl. No.: 12/827,032

(22) Filed: Jun. 30, 2010

(65) Prior Publication Data

US 2012/0000618 A1 Jan. 5, 2012

(51) Int. Cl.
*D21C 9/00* (2006.01)

(52) U.S. Cl.
USPC ..... 162/192; 162/50

(58) Field of Classification Search
USPC ..... 162/50, 192
See application file for complete search history.

(56) References Cited

U.S. PATENT DOCUMENTS

| | | | |
|---|---|---|---|
| 5,498,478 | A | 3/1996 | Hansen et al. |
| 6,340,411 | B1 | 1/2002 | Hansen et al. |
| 6,436,231 | B1 | 8/2002 | Graef et al. |
| 6,782,637 | B2 | 8/2004 | Yancey et al. |
| 7,018,508 | B2 | 3/2006 | Yancey et al. |
| 2003/0121623 | A1 | 7/2003 | Westland et al. |

FOREIGN PATENT DOCUMENTS

EP 125851 A1 * 11/1984

OTHER PUBLICATIONS

Vander Wielen et al., Analysis of the topochemical effects of dielectric-barrier discharge on cellulosic fibers, 2005, Cellulose, p. 185-196.*

* cited by examiner

*Primary Examiner* — Anthony Calandra
(74) *Attorney, Agent, or Firm* — Christensen O'Connor Johnson and Kindness LLC

(57) ABSTRACT

The process of making crosslinked cellulose pulp fiber comprising plasma treating a sheet of cellulose pulp fiber before the sheet is impregnated with a crosslinking formulation which comprises a crosslinking agent and a catalyst, then defiberizing the treated cellulose pulp sheet to form treated defiberized cellulose pulp, then heating and curing the treated defiberized cellulose pulp to form intrafiber crosslinked cellulose pulp fibers.

10 Claims, No Drawings

REDUCTION OF FIBER KNOTS OF CELLULOSE CROSSLINKED FIBERS BY USING PLASMA PRE-TREATED PULPSHEETS

The present invention relates to the process and apparatus for producing singulated crosslinked cellulose pulp fibers having low knots.

DETAILED DESCRIPTION

Crosslinked fibers are conventionally produced by wetting dried conventional pulp fibers with a solution containing a crosslinking agent. The pulp fibers are in sheet or extended sheet form and are usually in a roll. The wetted pulp sheet is hammermilled to individualize the pulp fibers in the pulp sheet. The hammermilled pulp containing a crosslinking agent is then run through a flash drier to dry the fibers and start the crosslinking process and further heated in an oven to complete the crosslinking process. The crosslinking is intrafiber crosslinking in which the cellulose molecules within a cellulose fiber are crosslinked. Intrafiber crosslinking imparts twist and curl to the cellulose fiber. Intrafiber crosslinking also imparts bulk to the fiber.

At the start of the crosslinking process the sheet of cellulose fibers is transported through the fiber treatment zone by a conveying device, for example, a conveyor belt or a series of driven rollers.

At the fiber treatment zone, a crosslinking agent formulation is applied to the sheet of cellulose fibers. The crosslinking agent formulation is preferably applied to one or both surfaces of the mat using any one of a variety of methods known in the art, including spraying, rolling, or dipping. Once the crosslinking agent formulation has been applied to the mat, the solution may be uniformly distributed through the mat by, for example, passing the mat through a pair of rollers.

After the sheet of fibers has been treated with the crosslinking agent, the wet sheet impregnated with crosslinking agent is fiberized by feeding the mat through a hammermill. The hammermill serves to disintegrate the mat into its component individual cellulose fibers, which are then air conveyed through a drying unit to remove the residual moisture.

The resulting treated pulp is then air conveyed through an additional heating zone (e.g., a dryer) to bring the temperature of the pulp to the cure temperature. In one embodiment, the dryer comprises a first drying zone for receiving the fibers and for removing residual moisture from the fibers via a flash-drying method, and a second heating zone for curing the crosslinking agent. Alternatively, in another embodiment, the treated fibers are blown through a flash-dryer to remove residual moisture, heated to a curing temperature, and then transferred to an oven where the treated fibers are subsequently cured. Overall, the treated fibers are dried and then cured for a sufficient time and at a sufficient temperature to effect crosslinking. Typically, the fibers are oven-dried and cured for about 1 to about 20 minutes at a temperature from about 120° C. to about 200° C.

The crosslinked fibers have unique combinations of stiffness and resiliency, which allow absorbent structures made from the fibers to maintain high levels of absorptivity, and exhibit high levels of resiliency and an expansionary responsiveness to wetting of a dry, compressed absorbent structure.

Cellulosic fibers useful for making the crosslinked cellulosic fibers are derived primarily from wood pulp. Suitable wood pulp fibers for use with the invention can be obtained from well-known chemical processes such as the kraft and sulfite processes, with or without subsequent bleaching. The pulp fibers may also be processed by thermomechanical, chemithermomechanical methods, or combinations thereof. The pulp fiber can be produced by chemical methods. Ground wood fibers, recycled or secondary wood pulp fibers, and bleached and unbleached wood pulp fibers can be used. One starting material is prepared from long-fiber coniferous wood species, such as southern pine, Douglas fir, spruce, and hemlock. Hardwood fibers such as aspen, birch or eucalyptus can also be used. Details of the production of wood pulp fibers are well-known to those skilled in the art. Suitable fibers are commercially available from a number of companies, including the Weyerhaeuser NR Company. For example, suitable cellulose fibers produced from southern pine that are usable in making the present invention are available from the Weyerhaeuser NR Company under the designations CF416, CF405, NF405, NB416, FR416, FR516, PW416 and PW405.

The crosslinking agent is applied to the cellulosic fibers in an amount sufficient to effect intrafiber crosslinking. The amount applied to the cellulosic fibers can be from about 1 to about 10 percent by weight based on the total weight of fibers.

Any one of a number of crosslinking agents and catalysts, if necessary, can be used to provide crosslinked fibers. The following are representative crosslinking agents and catalysts.

Suitable urea-based crosslinking agents include substituted ureas such as methylolated ureas, methylolated cyclic ureas, methylolated lower alkyl cyclic ureas, methylolated dihydroxy cyclic ureas, dihydroxy cyclic ureas, and lower alkyl substituted cyclic ureas. Specific urea-based crosslinking agents include dimethyldihydroxy urea (DMDHU, 1,3-dimethyl-4,5-dihydroxy-2-imidazolidinone), dimethylol dihydroxy ethylene urea (DMDHEU, 1,3-dihydroxymethyl-4,5-dihydroxy-2-imidazolidinone), dimethylol urea (DMU, bis[N-hydroxymethyl]urea), dihydroxyethylene urea (DHEU, 4,5-dihydroxy-2-imidazolidinone), dimethylolethylene urea (DMEU, 1,3-dihydroxymethyl-2-imidazolidinone), and dimethyldihydroxyethylene urea (DMeDHEU or DDI, 4,5-dihydroxy-1,3-dimethyl-2-imidazolidinone).

Suitable dialdehyde crosslinking agents include $C_2$-$C_8$ dialdehydes (e.g., glyoxal), $C_2$-$C_8$ dialdehyde acid analogs having at least one aldehyde group, and oligomers of these aldehyde and dialdehyde acid analogs. Particular crosslinking agents within this group are glutaraldehyde, glyoxal, glyoxylic acid, glycol, and propylene glycol. Other crosslinking agents are acetals such as 2,3-dihydroxy-1,1,4,4-tetramethoxybutane, 3,4-dihydroxy-2,5-dimethoxytetrahydrofuran, glyceraldehydes dimethylacetal and $C_2$-$C_8$ monoaldehydes having an acid functionality.

Suitable aldehyde crosslinking agents include aldehyde and urea-based formaldehyde addition products such as N-methylol urea, and dimethylol urea; formaldehyde, difunctional aldehydes such as glutaraldehyde; dichloro acetic acid, dichloro propanol-2, diepoxides, such as butadiene diepoxides, polyepoxides, N-methylol acrylamide, and divinylsulfone, glyoxal adducts of ureas, and glyoxal/cyclic urea adducts, condensation products of formaldehyde with organic compounds, such as urea, thiourea, guanidine, or melamine or other chemical compounds which contain at least two active hydrogen groups, such as dimethylolurea, dimethylol ethyleneurea and imidazolidine derivatives; dicarboxylic acids; dialdehydes such as glyoxal; diisocyanates; divinyl compounds; diepoxides, dihalogen-containing compounds such as dichloracetone and 1,3-dichloropropanol-2; and halohydrins such as epichlorohydrin, tetraoxan, glutaraldehyde, and tetrakis (hydroxymethyl) phosphonium chloride. These can be used with alkaline catalysts, such as sodium hydroxide.

When working with certain polymers such as urea-formaldehyde and melamine-formaldehyde, a mineral acid, such as sulfuric acid, may be added with the polymeric compound. The acid may be added in an amount sufficient to adjust the pH of the aqueous fiber slurry to from about 3.0 to about 5.5. It is believed that the acid acts as a catalyst to accelerate the reaction of the polymeric compound during the drying step.

Other suitable crosslinking agents include carboxylic acid crosslinking agents such as $C_3$-$C_9$ polycarboxylic acids that contain at least three carboxyl groups (e.g., citric acid, propane tricarboxylic acid, butane tetracarboxylic acid and oxydisuccinic acid). Specific suitable polycarboxylic acid crosslinking agents include tartaric acid, malic acid, succinic acid, glutaric acid, citraconic acid, itaconic acid, tartrate monosuccinic acid, maleic acid, polyacrylic acid, polymethacrylic acid, polymaleic acid, polymethylvinylether-co-maleate copolymer, polymethylvinylether-co-itaconate copolymer, copolymers of acrylic acid, and copolymers of maleic acid, polyacrylic acid and related copolymers and polymaleic acid, polyacrylic acid, having phosphorous incorporated into the polymer chain (as a phosphinate) by introduction of sodium hypophosphite during the polymerization process.

Suitable catalysts for the above mentioned crosslinking agents can include acidic salts, such as ammonium chloride, ammonium sulfate, aluminum chloride, magnesium chloride, magnesium nitrate, and more preferably alkali metal salts of phosphorous-containing acids, like phosphoric, polyphosphoric, phosphorous and hypophosphorous acids. The amount of catalyst used can vary. Mixtures or blends of crosslinking agents and catalysts can also be used.

Cellulosic fibers may be treated with a debonding agent prior to treatment with the crosslinking agent. Debonding agents tend to minimize interfiber bonds and allow the fibers to separate from each other more easily. However, debonding agents reduce the strength of the chemically treated pulp sheet before hammermilling which can cause web breakage, especially at higher production rates. The debonding agent may be cationic, nonionic or anionic. Cationic debonding agents appear to be superior to nonionic or anionic debonding agents. The debonding agent typically is added to cellulose fiber stock.

Suitable cationic debonding agents include quaternary ammonium salts. These salts typically have one or two lower alkyl substituents and one or two substituents that are or contain fatty, relatively long-chain hydrocarbon. Nonionic debonding agents typically comprise reaction products of fatty-aliphatic alcohols, fatty-alkyl phenols and fatty-aromatic and aliphatic acids that are reacted with ethylene oxide, propylene oxide, or mixtures of these two materials.

A suitable debonding agent is Berocell 584 from Berol Chemicals, Incorporated of Metairie, La. It may be used at a level of 0.25% weight of debonder to weight of fiber.

Crosslinked pulp can have a knot content that is greater than 25%. Knots are unfiberized fiber clumps or pieces of the original pulp sheet. They can be seen by placing a small portion of pulp into a clear beaker of water and stirring the water to mix the fibers. Most of the fiber will mix into the water as single fibers, however there will be fiber clumps that are readily visible. The fiber clumps or knots are undesirable by-products of the hammermilling process. As production speeds increase, the level of knots increases as the hammermilling efficiency is reduced. Thus there is a need for increasing production speeds without increasing knots and without the sheet breaks associated with debonded pulp (as noted above).

The amount of knots in a pulp that has been hammermilled can be quantified by using a screening system with acoustical energy used as the means to classify the fiber into amounts of knots, accepts and fines. It is desirable to have low knots and fines and high accepts where the accepts are the singulated fibers. It is desirable to have a lower amount of knots in crosslinked pulp.

"2× Sonic knots" are tested by the following method for classifying dry crosslinked fluffed pulp into four layered fractions based on screen mesh size. The first fraction is the layer knots and is defined as that material that is captured by a No. 5 mesh screen. The second fraction is the intermediate knots and is defined as the material captured by a No. 8 mesh screen. The third fraction is the smaller knots and is defined as the material captured by a No. 12 mesh screen. The fourth fraction is the accepts or the singulated fibers and is defined as that material that passes through No. 5, 8, and 12 mesh screens but is captured by a No. 60 mesh screen. The separation is accomplished by sound waves generated by a speaker that are imposed upon a pre-weighed sample of fluff pulp placed on the first layered No. 5 mesh screen that is near the top of a separation column where the speaker sits at the very top. After a set period of time, each fraction from the No. 5, 8 and 12 screens is removed from the separation column and is added back to the No. 5 screen for the second pass through the sonic test. After the set period of time, each fraction from the No. 5, 8 and 12 screens is removed from the separation column and weighed to obtain the weight fraction of knots, accepts/singulated fiber and fines.

The inventors have discovered a treatment for pulp that reduces the knot content of crosslinked cellulose pulp fibers which is especially applicable at higher production rates. This is unexpected because the same treatment either does not affect or slightly increases the knot content of treated cellulose pulp fibers that have not been crosslinked.

The treatment is a plasma pre-treatment of the pulp sheet before the application of the crosslinking formulation which includes the crosslinking agent and catalyst if desired. In one embodiment, the pulp sheet could be pre-treated with plasma prior to delivery to the crosslinking facility. Additionally, in another embodiment the pulp rolls could be plasma pre-treated off line prior to crosslinking in the crosslinking facility.

Plasma can be defined as a substance, where many of the atoms or molecules are effectively ionized, allowing charges to flow freely. This collection of charged particles containing about equal numbers of positive ions and electrons exhibits some properties of a gas but differs from a gas in being a good conductor of electricity and in being affected by a magnetic field. Some scientists have dubbed plasma the "fourth state of matter" because while plasma is neither gas nor liquid, its properties are similar to those of both gases and liquids.

With the addition of heat or other energy, a significant number of atoms release some or all of their electrons. This leaves the remaining parts of those atoms with a positive charge, and the detached negative electrons are free to move about. These atoms and the resulting electrically charged gas are said to be "ionized". When enough atoms are ionized to a point that significantly affects the electrical characteristics of the gas, it is a plasma. Plasmas can carry electrical currents and generate magnetic fields and the most common method for producing a plasma is by applying an electric field to a gas in order to accelerate the free electrons.

Processes like corona treatment, gas atmosphere plasma, flame plasma, atmospheric plasma, low pressure plasma, vacuum plasma, glow-discharge plasma all rely on the properties of plasma.

The most common forms of atmospheric pressure plasmas are described below.

Corona Discharge (CD) Treatment:

Corona Treatment process is at the simple end of the plasma scale, and is a lower cost alternative. Corona discharge is characterized by bright filaments extending from a sharp, high-voltage electrode towards the substrate. Corona treatment is the longest established and most widely used plasma process; it has the advantage of operating at atmospheric pressure, the reagent gas usually being the ambient air.

In corona treatment the pulp sheet travels between a high voltage electrode and a ground electrode. The high voltage electrode (with highly asymmetric geometry, examples being sharply pointed needle or thin wire electrodes opposing flat planes of large diameter cylinders) faces one side of the pulp sheet and the ground electrode faces the opposite side of the pulp sheet. Typically there is a dielectric covering the ground electrode (which is typically a roll). In some corona discharge stations the dielectric covers the high voltage electrode instead of the ground electrode. In another embodiment, both sides of the pulp sheet are treated.

The electrodes are powered with high, continuous or pulsed DC or AC voltages. The high electric field around the point of the needle or the wire causes electrical breakdown and ionization of whatever gas surrounds the needle (wire) and plasma is created, which is discharges in a fountain-like spray out from the point or wire. Plasma types are characterized by the number, density and temperature of the free electrons in the system. Coronas are very weakly ionized with a free electron density of about $10^8$ electrons/cm$^3$. The corona is strongly non-thermal with very high energy free electrons with temperatures in excess of 100000 K.

A high frequency generator and a high voltage output transformer is attached to the high voltage electrode. This raises the incoming electricity from, typically, a frequency of 50 to 60 Hz and a voltage of 230 V to a frequency of 10 to 35 kHz and a voltage of 10 kV. The power source is rated in watts or kilowatts.

Dielectric Barrier Discharge (Silent Discharge):

The dielectric barrier discharge is a broad class of plasma sources that has an insulating (dielectric) cover over one or both of the electrodes and operates with high voltage (1-20 kV) power running at frequencies of 1 to 100 kHz. This results in a non-thermal plasma and a multitude of random, numerous arcs form between electrodes. (which in contrast to the corona system, have symmetrical geometry—two parallel conducting plates) placed in opposition to each other. The DBD plasma is large area, non-thermal and more uniform than the CD. Because of charge accumulation on the dielectric, which tends to neutralize the applied electric field thus choking off the plasma, the DBD must be powered by AC. This kind of plasma is denser than the corona with a typical free electron density of about $10^{10}$ electrons/cm$^3$ but the free electrons are slightly cooler at temperatures of 20000 to 50000 K.

Atmospheric Pressure Glow Discharges (APGD):

Glow discharge is characterized as a uniform, homogeneous and stable discharge usually generated in helium or argon (and some in nitrogen). The APGD is generated by application of relatively low (~200 V) voltages across symmetrical planar or curved electrodes, at high frequency, or even very high frequency, radio frequencies 2-60 MHz, much higher than the other plasma types. The electrodes are not covered by dielectric, but are bare metal, which enables significantly higher power densities (up to 500 W/cm$^3$). The APGD is denser than the DBD, with typical free electron densities of $10^{11}$-$10^{12}$ electrons/cm$^3$, but the free electron are slightly cooler at temperatures 10000 to 20000 K.

Other than ambient air, gases, such as but not limited to, helium, argon, nitrogen, hydrogen and oxygen may be used to generate plasma.

As production rates increase during crosslinking, there is less time for the crosslinking formulation to penetrate the sheet before hammermilling. This is known to cause an increase in knots. Without being limited to theory, applicant believes that pre-treatment with plasma disrupts the hydrogen bonding of the pulp sheet surface(s) thereby improving or enhancing the penetration or impregnation of the crosslinking formulation into the pulp sheet. Thus plasma treated pulp sheets remove this limitation allowing faster production. In one embodiment the pulp sheet is pre-treated with plasma, such as corona discharge, then treated with crosslinking agent, then hammermilled or otherwise defiberized, then heat treated to first dry the sheet and start the crosslinking reaction and further heated to crosslink the fibers. If the plasma treatment is corona treatment, the corona treatment can be from 54 to 162 Watts/m$^2$/min.

The plasma treatments that can be used on the pulp sheet are a corona discharge, dielectric barrier discharge, atmospheric pressure glow discharge, and diffuse coplanar surface barrier discharge. In one embodiment the plasma pre-treatment of the pulp sheet will provide a crosslinked pulp fiber product having knot content is less than 25% based on the sonic fractionation test. In another embodiment the plasma pre-treatment of the pulp sheet will provide a crosslinked pulp fiber product having knot content is less than 20% based on the sonic fractionation test. In another embodiment the plasma pre-treatment of the pulp sheet will provide a crosslinked pulp fiber product having knot content is less than 15% based on the sonic fractionation test.

A cellulose pulp sheet is a sheet of cellulose wood pulp fibers that have been dried to a water content of less than 10%. The pulp fibers are hydrogen bonded together. The pulp sheet has a basis weight of 500 to 1200 g/m$^2$ and is typically available in roll or bale form. Several rolls of pulp were corona treated and tested for sonic knots. The pulp was CF416, a southern pine kraft pulp without debonder available from Weyerhaeuser NR Company. The corona treated level was 108 Watts/m$^2$/min. The sonic knots test was as described above.

TABLE 1

| | Roll 1 | | Roll 2 | | Roll 3 | |
|---|---|---|---|---|---|---|
| | Control | Treated | Control | Treated | Control | Treated |
| Sonic knots | 8 | 11 | 8 | 10 | 10 | 11 |

Rolls of southern pine softwood kraft pulp (CF416) were corona treated at three different levels, and crosslinked with polyacrylic acid. The samples were tested for sonic knots.

TABLE 2

| | Control | 1 | 2 | 3 |
|---|---|---|---|---|
| Corona Watts/m$^2$/min | — | 86 | 108 | 162+ |
| Sonic knots | 24.3 | 21.2 | 17.0 | 13.9 |
| % improvement | — | 12.8 | 30 | 42.7 |

The crosslinked material had a marked improvement in knots when corona treated. This was not the case with non-crosslinked pulp in which sonic knots became greater after corona treatment.

The invention claimed is:

1. A process of making crosslinked cellulose pulp fiber, comprising plasma treating at least one side of a sheet of cellulose pulp fiber, to provide a plasma treated sheet;

wherein the plasma treatment is corona discharge (CD) and wherein the corona discharge (CD) treatment is at least 54 Watts/$m^2$/min;

treating the plasma treated sheet with a crosslinking agent, to provide a crosslinking agent treated sheet;

defiberizing the crosslinking agent treated sheet to form treated defiberized cellulose pulp; and heating and curing the treated defiberized cellulose pulp to form individual intrafiber crosslinked cellulose pulp fibers, wherein the individual intrafiber crosslinked cellulose pulp fibers have a knot content that is less than individual intrafiber crosslinked cellulose pulp fibers formed with the crosslinking agent but without plasma treatment.

2. The process of claim 1, wherein the corona treatment is in the range of 54 to 162 Watts/$m^2$/min.

3. The process of claim 1, wherein the defiberization is hammermilling the crosslinking agent treated sheet.

4. The process of claim 2, wherein the defiberization is hammermilling the crosslinking agent treated sheet.

5. The process of claim 1, where the plasma is generated using a gas selected from argon, helium, hydrogen, nitrogen, or oxygen.

6. The process of claim 1, wherein the individual intrafiber crosslinked cellulose pulp fibers have a knot content of less than 20% based on the sonic fractionation test.

7. The process of claim 1, wherein the individual intrafiber crosslinked cellulose pulp fibers have a knot content of less than 15% based on the sonic fractionation test.

8. The process of claim 1, wherein the crosslinking agent comprises polyacrylic acid.

9. The process of claim 1, wherein the sheet of cellulose pulp fiber is produced by a chemical process.

10. The process of claim 9, wherein the chemical process is selected from the group consisting of a kraft process and a sulfite process.

* * * * *